United States Patent [19]

Bens, Jr.

[11] Patent Number: 4,463,832

[45] Date of Patent: Aug. 7, 1984

[54] INDUSTRIAL TRUCK

[75] Inventor: Edward F. Bens, Jr., Lexington, Ky.

[73] Assignee: Clark Equipment Company, Buchanan, Mich.

[21] Appl. No.: 366,621

[22] Filed: Apr. 8, 1982

[51] Int. Cl.[3] ..... B66B 9/20

[52] U.S. Cl. ..... 187/9 R; 180/61; 414/634

[58] Field of Search ..... 187/9 R, 9 E; 180/13, 180/11, 12, 14 R, 19 S, 19 H, 61, 59, 295, 299; 414/630, 632, 634, 637, 638

[56] References Cited

U.S. PATENT DOCUMENTS

| | | | |
|---|---|---|---|
| 915,667 | 3/1909 | Ducasse | 180/61 |
| 1,882,036 | 10/1932 | Remde | 414/634 |
| 2,623,653 | 12/1952 | Framhein | 414/634 |
| 3,756,350 | 9/1973 | Gandolfo et al. | 157/9 R |

*Primary Examiner*—H. Grant Skaggs
*Assistant Examiner*—Kenneth Noland
*Attorney, Agent, or Firm*—Mack L. Thomas; John C. Wiessler

[57] ABSTRACT

An industrial truck of the narrow-aisle type having an upright rigidly connected to the frame of the truck and a drive unit pivotably connectible to the frame in certain selected rigid angular relationships in order to vary between predetermined limits the vertical angularity of the upright. The latter connection includes adjustable rigid connection members or struts mounted inwardly of the sides of the truck so that the upright can be securely mounted inwardly of upright members of the frame whereby to increase the lateral rigidity of the upright by adding thereto at least partially the lateral rigidity of the frame.

13 Claims, 10 Drawing Figures

INDUSTRIAL TRUCK

BACKGROUND OF THE INVENTION

1. Field of the Invention

This invention relates to material handling industrial trucks and is particularly suitable for an industrial truck which includes a mobile frame having a centrally located mast or upright structure upon which a load carriage is mounted for lifting and lowering movement. The load carriage may include an operator's station which moves upwardly and downwardly with the load.

2. Description of the Prior Art

The industrial truck mentioned is of the counterbalanced or non-straddle type. The frame extends sufficiently to the front and rear of the centrally located mast structure, and laterally, to provide vehicle stability. At the front of the machine is located a drive unit assembly which is pivotally connected to the truck frame and which includes a drive-steer wheel for steering, propelling and braking the machine. At the rear of the vehicle pairs of unidirectional support wheels are located on the frame.

It is known to assemble a non-counterbalanced or straddle type industrial truck from some of the same sub-assemblies or modules that are used for counterbalanced type trucks. In the straddle type industrial truck, the frame is lengthened at the rear and the frame is ordinarily equipped with caster wheels near the outer forward edges thereof and laterally of the drive-steer wheel. Outrigger portions are added to the rear sides of the frame, the rear end being supported by a pair or pairs of uni-directional wheels.

U.S. Pat. No. 3,756,350, Gandolfo et al., dated Sept. 4, 1973, discloses industrial truck modules which can be assembled to form either the straddle type or the counterbalanced type industrial truck described above. The industrial truck shown in FIGS. 1, 3 and 5 of that patent is of the straddle type while that shown in FIGS. 2 and 4 is the counterbalanced type. The present invention is adapted to be used with either the straddle or counterbalanced type industrial truck.

Heretofore in order selector type lift trucks as herein contemplated various means have been utilized to adjust the upright to predetermined vertical or tilted positions as required for satisfactory operation with varying load induced upright deflections, tire wear factors and the like. In order selector trucks wherein the operator's station is located on the elevatable load carriage from which all operating components of the truck are controlled it is desirable to adjust the upright to, for example, a vertical angle between 0° and 1° back-tilt. On newly assembled vehicles such an adjustment is necessary to compensate for manufacturing tolerances and the variations in vehicle weight and center of gravity locations, as well as for any back-tilt resulting from upright extension. Over a period of time of lift truck operation any change in the vertical position of the upright due to the normal wear of such components as tires and upright rollers may require such an upright adjustment from time to time.

Most, if not all, of standard four-wheel, sit-down, counterweighted type lift trucks wherein the upright is mounted at the front of the truck utilize hydraulically operable tilt cylinders for tilting the upright and the load forwardly and rearwardly to compensate for load induced upright deflections and for use in picking up, transporting and depositing loads.

Lift trucks of the narrow aisle and order selector type as herein disclosed utilize an upright that is fixedly secured to the chassis or truck frame with adjustment of the vertical position of the upright during manufacture and assembly of the truck being effected by various known means. Such known means may include adjustment of the upright by shimming flange bolted connections thereof to frame support members such as, in practice, may be done in the structure of the above Gandolfo et al. patent by locating shims between the upright flanges and upright frame support members adapted to be connected thereto.

Another structure used by certain manufacturers is shown on the enclosed specification sheet entitled "Frame and Mast Assembly" whereon applicant has added the legend "Outriggers welded at slight downward angle", which permanently effects one desired tilt angle.

Again, the tilt angle may be varied by mounting the upright on trunnions for pivotal movement and utilizing "turn-around" brackets, such as in U.S. Pat. No. 3,378,159, Trusock, dated Apr. 16, 1968.

Copending application Ser. No. 260,969, Jones, filed May 6, 1981 now U.S. Pat. No. 4,431,084, common assignee, discloses a lift truck of the same general configuration and structure as herein, but for a straddle type vehicle wherein in one embodiment a sole fixed adjustment position of the upright is provided in contrast to the multiple adjustment positions thereof as provided by my invention.

In the specially welded assembly above referred to upright readjustment is not possible, and in the patented structures noted above it is difficult and time consuming. In the above mentioned copending application no provision is made for such upright adjustment. Furthermore in none of the above adjustable upright constructions does the resulting structural connection between the upright and the frame substantially increase the overall lateral structural rigidity of the upright, which is effected in my invention by adding the structural lateral rigidity of the truck frame to the lateral rigidity of the upright. My construction also provides a relatively easy means for adjusting the upright vertical angularity.

SUMMARY

A lift truck of the narrow-aisle type wherein an adjustable rigid member interconnects the frame and drive unit in such a manner that the structural rigidity of the upright is enhanced by the structural rigidity of the truck frame and the fixed vertical angularity of the upright may be readily adjusted between predetermined limits.

DESCRIPTION OF THE PREFERRED EMBODIMENT

Figure 1:
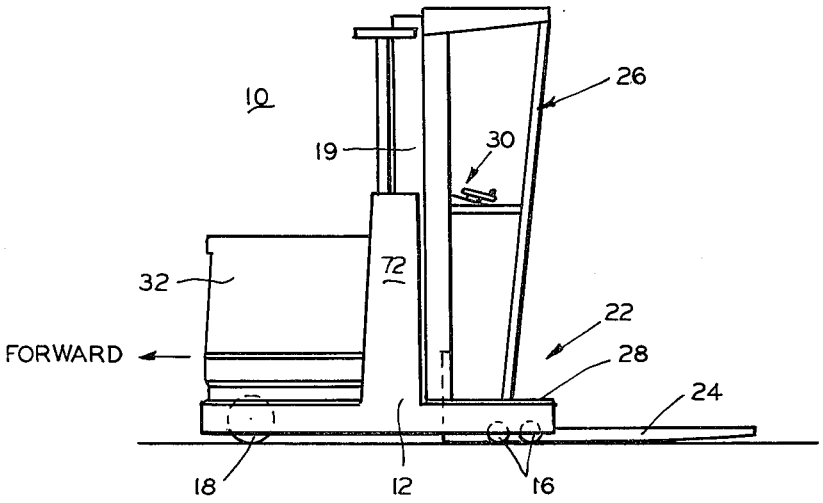
FIG. 1 is a side elevation of an industrial truck embodying this invention.

The numeral 10 designates generally a battery powered industrial truck which embodies this invention. The truck is of a non-straddle, counterweighted type shown for illustration only, it being understood that the invention is applicable to any suitable type industrial truck, ordinarily either of the order-picker type wherein the operator's station and truck controls are located to elevate with the fork or of a stand-up rider type, all such industrial trucks being particularly adapted for operation in narrow aisles.

The vehicle 10 includes a rigid frame 12 having a longitudinal axis 14 and pairs of uni-directional rear wheels 16 on opposite sides of the frame. At the front of the vehicle is a centrally located drive-steer wheel 18 which with its associated structure comprises a part of a pivotally mounted drive unit 20 which is shown in FIGS. 3 and 4.

As shown, the industrial truck includes a vertically extendible mast or upright structure 19 which is mounted on frame 12. Carried on the mast structure is a load carriage 22 including fork tines 24 and an operator's station indicated generally at 26 which includes an operator's platform 28 and controls at 30. A compartment 32 houses the drive unit and a drive battery.

Figure 3:
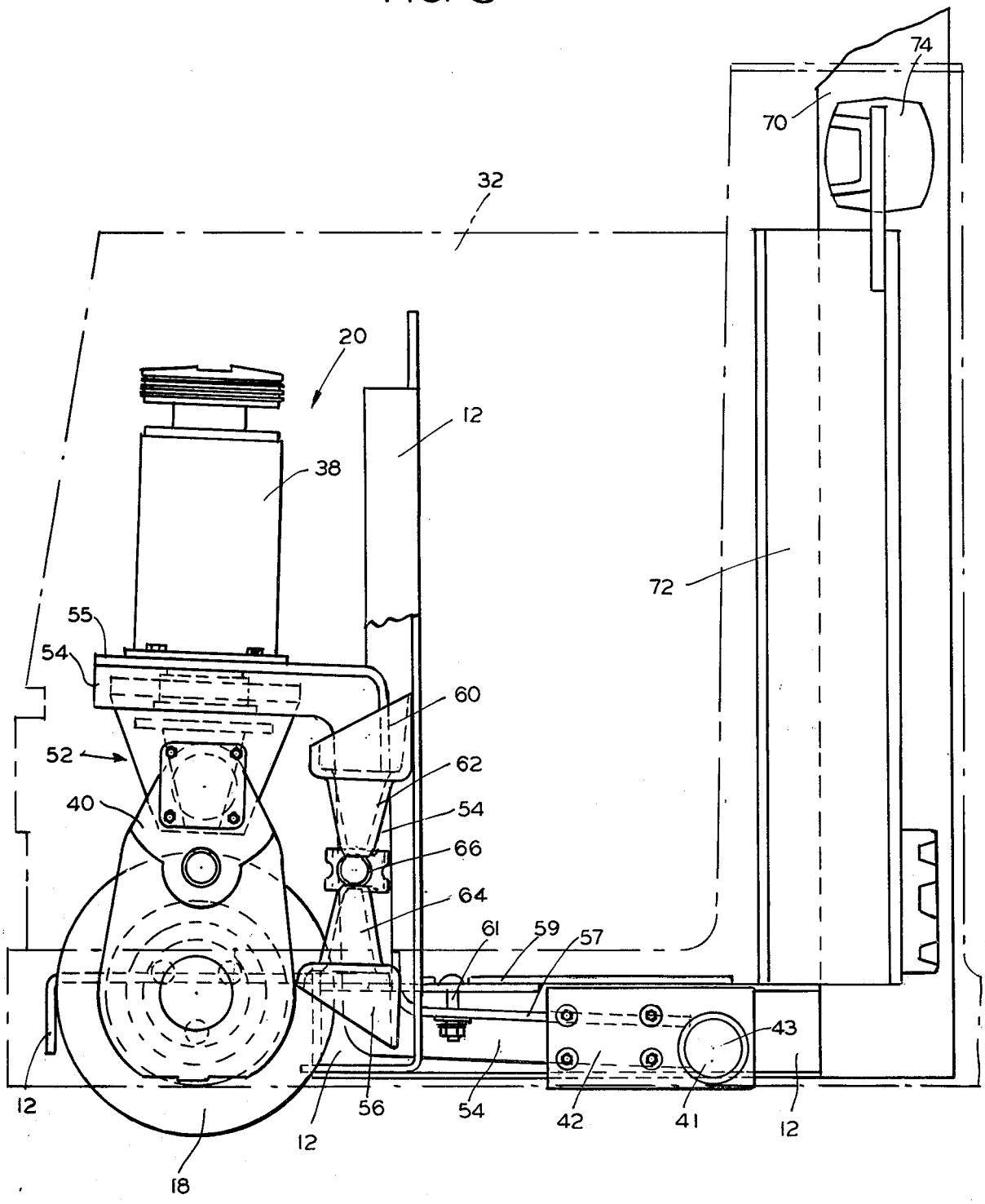
FIG. 3 is a side view of the truck partially in phantom showing the pivoted drive unit of the invention and the connection thereof to the truck frame and upright.
Figure 4:
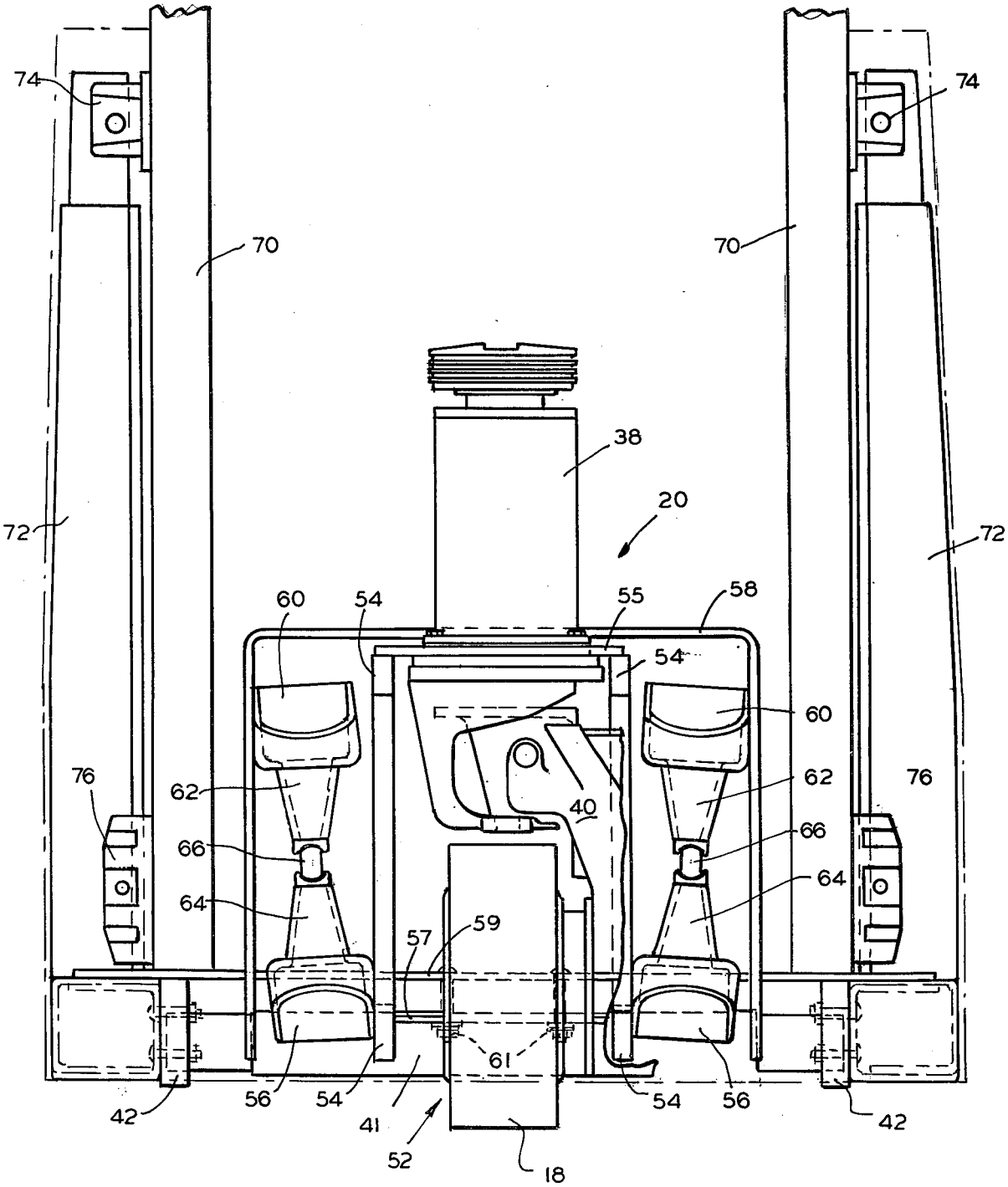
FIG. 4 is an end elevational view of FIG. 3.

As shown in FIGS. 3 and 4 the drive unit 20 includes in addition to traction wheel 18, an electric motor 38 for operating wheel 18. Between motor 38 and wheel 18 is a gear speed reduction unit 40 and as shown it is also a part of the drive unit structure. The drive unit 20 includes sub-assembly 52 which is mounted on frame 12 for adjustable pivotal movement with a transverse horizontal pivot shaft 41 having an axis 43. The sub-assembly 52 includes a pair of transversely spaced structural members 54 which extend horizontally rearwardly at an upper level, then downwardly, and then further rearwardly at a lower level, as best shown in FIG. 3. Across the top of the forward portion of members 54 is secured a horizontal structural member 55; the assembly of wheel 18, motor 38 and gear unit 40 is mounted on member 55 for swivel movement to provide for steering of the industrial truck by turning wheel 18. The pivot shaft 41 is secured transversely of the rear ends of members 54.

A pair of lower strut brackets 56 is secured to the outer surfaces of the vertical structural portion of members 54 as a part of the subassembly 52. The frame 12 includes a forwardly projecting inverted U-shaped structural member 58. A pair of upper strut brackets 60 is secured to the inner surfaces of opposite sides of member 58.

Figure 5A:
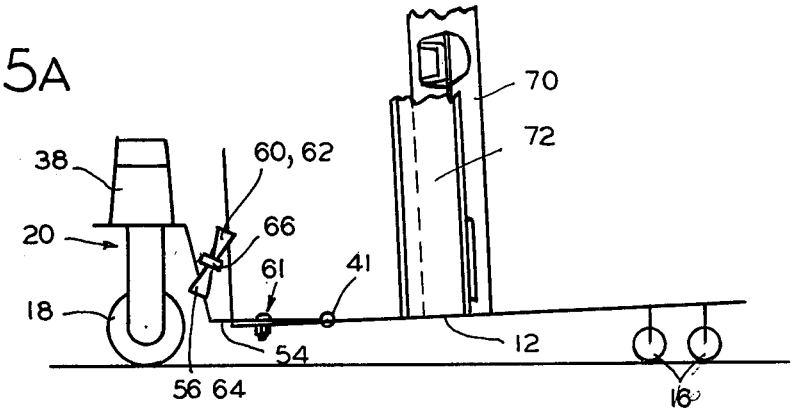
FIGS. 5A and B are diagrammatic side views of the lift truck drive unit, frame and upright showing two of the adjustment positions of the frame and upright in accordance with the invention.
Figure 5B:
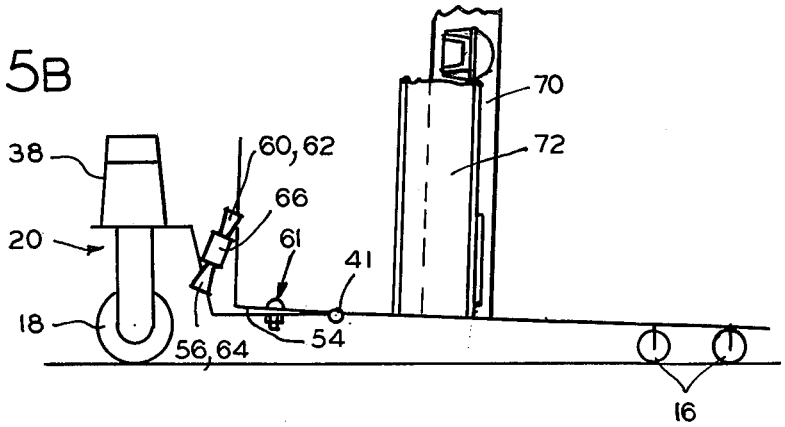

Complementary pairs of opposed rigid strut members 62 and 64 project downwardly and upwardly, respectively, in allochiral relationship from secure connections to the respective pairs of upper and lower strut brackets 60 and 56. The pairs of projecting opposed strut members are connected adjustably by a pair of adjustable strut blocks 66, one of which is shown in different views in FIG. 6 taken from various sides of a block 66. Diagrammatic views of the overall relationship of the drive unit, frame, upright and struts are shown in FIGS. 5A and 5B in two different adjustment positions of the struts which will be described in greater detail hereinafter.

The rearwardly extending lower legs of drive unit support members 54 are connected securely to each other by a transverse plate member 57 which is spaced below horizontal plate member 59; the latter member extends transversely of the truck to connect together pivot plates 42 from the top edges thereof, plates 42 being in turn secured at the rearward edges to a transversely extending member of frame 12. Opposite ends of pivot shaft 41 engage and are supported by frame pivot plates 42 for pivotal adjustment of the frame 12 in relation to the drive unit 20.

Figure 2:
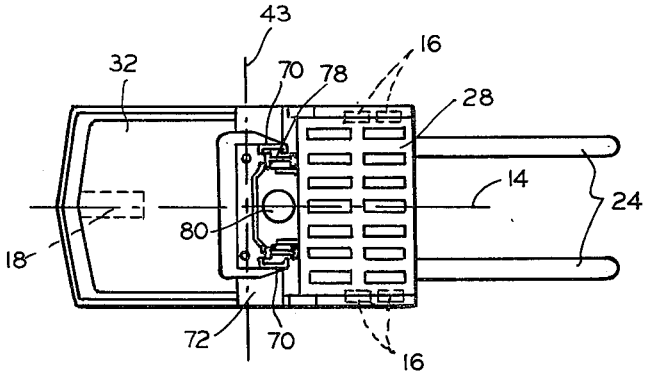
FIG. 2 is a plan view of the same industrial truck.

The upright 19, of known construction, includes a pair of laterally spaced channel members 70 secured to vertical members 72 of frame 12 by upper and lower pairs of bolted bracket connectors 74 and 76. In FIG. 2 may be seen in schematized plan view the well-known arrangement of telescopic nested I-beams 78 and a lift cylinder represented at 80 adapted to elevate the fork carriage 22 and operator's station 26 relative to the inner telescopic section 78 and the latter relative to the fixed channel beams 70.

Figure 7:
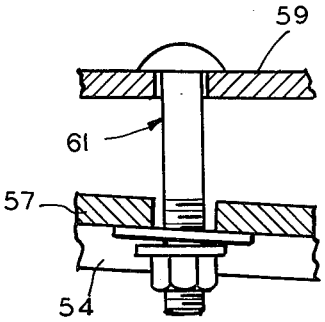
FIG. 7 is a broken-away view showing one of a pair of clamping bolt structures which is adapted to be located between and connect together the frame and drive unit assembly.

As shown in FIGS. 3, 4 and 7, plate member 59 is secured to plate member 57 by a pair of clamping bolt assemblies 61 which securely connect together the frame and drive unit as the clamping bolt elements are adjusted into secure abutment with the respective frame and drive unit members at any given adjustment position of struts 56,60,62,64,66.

The battery and counterweight compartment is shown best in the transverse vertical space in FIG. 3 between the vertical frame members 12 within compartment 32.

Figure 6:
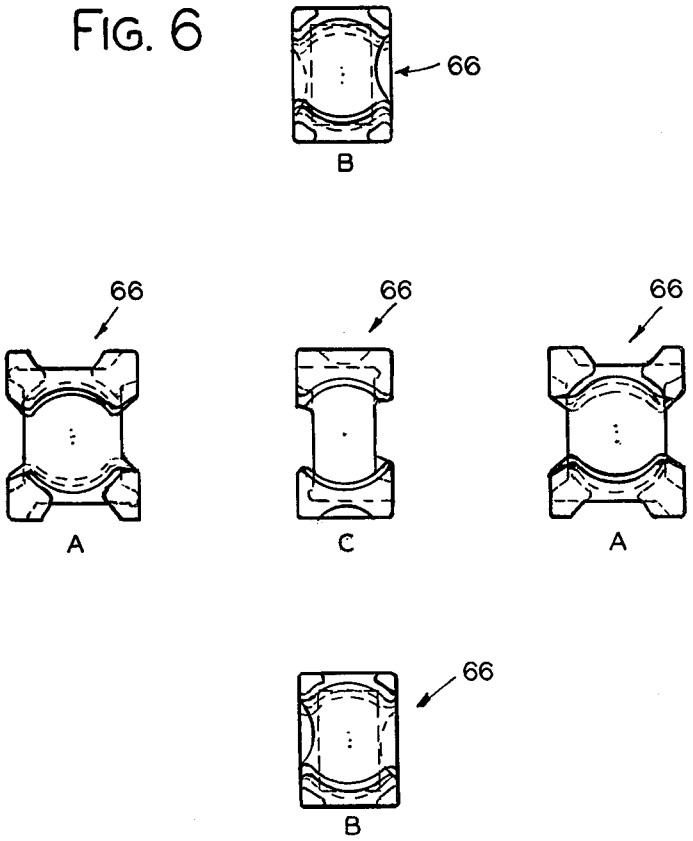
FIGS. 6A, B and C are views of different sides of a rigid adjustable connector member located between the frame and drive units.

FIG. 6 represents opposed faces or sides A, B and C (only one face of C being shown) of each adjustment block 66 having three different selected dimensions in height, width and thickness in order to adjust the degree of angularity of the upright 19 either at the time of truck manufacture or during service. During service the adjustment may be made by loosening clamp bolts 61 a sufficient amount and tilting in a clockwise direction the frame and upright assembly relative to the drive unit, as by a hydraulic jack or other lifting device. Then the adjustment strut blocks 66 may be removed as the strut members 62 and 64 separate and reinserted at a selected other one of the three available dimensions of height, width and thickness, whereupon the clamping bolts may be again tightened, the selected tilt angle of the upright being thereby established. As shown in FIG. 3, for example, the adjustment block 66 is installed so that the width of the block is effective to maintain the upright 20 in a true vertical position in relation to a horizontal plane surface. Loosening of the clamping bolts so that the upright may be adjusted to a rearward angle of tilt in relation to the vehicle may be accomplished by removing and reinserting the adjustment blocks 66 so that the maximum distance, or the height of the adjustment blocks, is effective between strut members 62 and 64, which dimension is illustrated in FIG. 3 along the substantially horizontal axis of the block as there shown. Such an adjustment effects a clockwise movement of the frame and upright assembly about pivot shaft 41 as the strut elements 62 and strut brackets 60 are actuated clockwise with the long dimension of the adjustment blocks in place between pairs of strut members 62 and 64. The thus established relationship is shown in exaggerated form in FIG. 5B.

Similarly an adjustment of blocks 66 to establish the shortest or thickness dimension thereof effective between the strut members causes a slight counterclockwise adjustment of the frame and upright assembly in relation to a vertical reference, as is illustrated in FIG. 5A.

Referring again to FIG. 6 it will be noted that the various faces of the different sides of the adjustment block are suitably contoured to provide recesses adapted to receive the adjacent end portions of strut members 62 and 64 so that a rigid and fixed connection exists at any given adjustment position when clamping bolts 61 are tightened.

While I have described and illustrated my invention in the best mode contemplated for carrying it out, it will be appreciated that modifications may be made. Accordingly, I intend to cover by the appended claims all modifications and equivalents falling within the true spirit and scope of this invention.

I claim:

1. In a lift truck having a rigid frame supported adjacent one end by wheel means, an upright assembly mounted on the frame and a drive unit adjacent the other end of the lift truck pivotally mounted on said frame, opposed first connector means mounted on said frame and on said drive unit adapted to be operably connected to each other by an adjustable connector member which is adapted to effect by adjusting the pivotal relation between said frame and drive unit first and second predetermined adjustment positions of said upright, and said adjustable connector member consists of a second connector means located intermediate said pivotal connection and said opposed first connector means and adapted to secure together as a single rigidly connected unit said drive unit and frame at either of said first or second adjustment positions of said upright.

2. A lift truck as claimed in claim 1 wherein said upright is mounted generally centrally of the lift truck, drive battery means is adapted to be located forwardly of the upright, and an operator's station is located rearwardly of the upright and is connected thereto for elevation therewith.

3. A lift truck as claimed in claim 1 wherein a drive-steer wheel is swivel mounted on said drive unit forwardly of said upright, said pivotal connection between said drive unit and said frame being located rearwardly of said drive-steer wheel and said opposed connector means being located intermediate said drive-steer wheel and said pivotal connection.

4. A lift truck as claimed in claim 1 wherein said adjustable connector member is adapted to effect a third predetermined adjustment position of said upright wherein said frame and drive unit are adapted to be secured as a single rigidly connected unit.

5. A lift truck as claimed in claim 4 wherein said three adjustment positions of said upright comprises a first position tilted forwardly of a vertical position, a second position tilted rearwardly of a vertical position, and a third position intermediate said first and second positions.

6. A lift truck as claimed in claim 1 wherein said opposed connector means comprises a pair of generally vertical struts spaced transversely outwardly on opposite sides of said drive unit, each strut comprising an upper frame mounted element and a lower drive unit mounted element extending towards each other in opposed relation and said adjustable connector member being mounted between each pair of said struts to form therewith a rigid connection.

7. A lift truck as claimed in claim 1 wherein said second connector means comprises a bolt means inserted through rigid members of said frame and drive unit adjustable to establish a tight relationship between said frame and drive unit members whereby to effect said single rigidly connected unit at either adjusted position of said upright.

8. In a lift truck having a rigid frame supported adjacent one end by wheel means, an upright assembly mounted on the frame and a drive unit adjacent the other end of the lift truck pivotally mounted on said frame, opposed connector means mounted on said frame and on said drive unit adapted to be operably connected to each other by an adjustable connector member which is adapted to effect by adjusting the pivotal relation between said frame and drive unit first and second predetermined adjustment positions of said upright, and said adjustable connector member comprising a member having first and second parallel surfaces spaced at a first predetermined distance, said member having a first position between said opposed connector means wherein the said first and second surfaces engage the opposed connector means to effect said first adjustment position of said upright, said member having third and fourth parallel surfaces at a second spaced predetermined distance, said member being adjustable wherein said third and fourth surfaces engage between said opposed connector means to effect said second adjustment position of said upright.

9. A lift truck as claimed in claim 8 wherein said connector member includes fifth and sixth parallel surfaces spaced at a third predetermined distance, said member being adjustable to engage said fifth and sixth surfaces with said opposed connector means to effect a third adjustment position of said upright.

10. A lift truck as claimed in claim 9 wherein said adjustable connector member is in the form of a block having three pairs of opposed, spaced apart parallel sides wherein said first and second, third and fourth, and fifth and sixth surfaces comprise the respective pairs of sides of said member.

11. A lift truck as claimed in claim 8 wherein said opposed connector means comprises a pair of oppositely projecting strut members spaced apart by said adjustable connector member, and a second connector means adapted to secure together as a single rigidly connected unit said drive unit and frame at either of said first or second adjustment positions of said upright.

12. A lift truck as claimed in claim 11 wherein at either given adjusted position of said upright said adjustable connector member is securely wedged between said strut members.

13. A lift truck as claimed in claim 8 wherein each surface of the adjustable member includes a portion conformed to receive terminal ends of said opposed connector means.

* * * * *